US010987602B1

(12) United States Patent
Shimoda

(10) Patent No.: US 10,987,602 B1
(45) Date of Patent: Apr. 27, 2021

(54) WEIGHT DEVICE FOR MODEL CAR

(71) Applicant: Seiji Shimoda, Hokkaido (JP)

(72) Inventor: Seiji Shimoda, Hokkaido (JP)

( * ) Notice: Subject to any disclaimer, the term of this patent is extended or adjusted under 35 U.S.C. 154(b) by 0 days.

(21) Appl. No.: 16/889,804

(22) Filed: Jun. 2, 2020

(51) Int. Cl.
*A63H 17/26* (2006.01)
*A63H 30/04* (2006.01)

(52) U.S. Cl.
CPC ..... *A63H 17/262* (2013.01); *A63H 30/04* (2013.01)

(58) Field of Classification Search
CPC ..... A63H 17/262; A63H 30/04; F16F 15/363; B60B 15/28
USPC ..... 446/431, 465; 301/53.5, 5.22
See application file for complete search history.

(56) References Cited

U.S. PATENT DOCUMENTS 2,909,389 A * 10/1959 Wilborn ..... B60C 19/003 301/5.22
3,314,726 A * 4/1967 Rehnborg ..... F16F 15/363 301/5.22
3,346,303 A * 10/1967 Wesley ..... F16F 15/363 301/5.22
3,427,077 A * 2/1969 Whitlock ..... F16F 15/363 301/5.22
3,716,093 A * 2/1973 Tsuchiya ..... B60C 5/005 152/450
3,724,904 A * 4/1973 Nixon ..... F16F 15/363 301/5.22
3,913,980 A * 10/1975 Cobb, Jr. ..... G01M 1/36 301/5.22
4,674,356 A * 6/1987 Kilgore ..... F16F 15/363 301/5.22
5,048,367 A * 9/1991 Knowles ..... F16F 15/366 301/5.22
5,460,017 A * 10/1995 Taylor ..... F16F 15/363 68/23.2
5,503,464 A * 4/1996 Collura ..... B60B 19/06 301/5.22
6,719,374 B2 * 4/2004 Johnson ..... B60B 15/28 301/5.22
7,014,272 B1 * 3/2006 Williamson ..... A63H 17/262 301/5.1
7,942,801 B2 * 5/2011 Ryu ..... B04B 9/14 494/82
8,011,737 B2 * 9/2011 Wang ..... A63H 17/262 301/53.5
8,057,277 B2 * 11/2011 Sip ..... B60B 25/20 446/465

(Continued)

FOREIGN PATENT DOCUMENTS

JP 2007-29139 A 2/2007

*Primary Examiner* — Alexander R Niconovich
(74) *Attorney, Agent, or Firm* — Yokoi & Co., U.S.A.; Toshiyuki Yokoi

(57) ABSTRACT

The present invention provides a weight device for a model car attached to an outer periphery of a wheel of the model car, the weight device having: an annular case extended along a circumferential direction of the wheel, the annular case having an annular internal space; and a plurality of weight members arranged in the annular internal space. The weight members are configured to be relatively movable in the circumferential direction with respect to the annular case when the annular case is rotated in the circumferential direction, and the annular case is attached to the outer periphery of the wheel so that the wheel is idly rotatable with respect to the annular case.

1 Claim, 5 Drawing Sheets

(56) References Cited

U.S. PATENT DOCUMENTS

| | | | | |
|---|---|---|---|---|
| 8,167,380 | B2 * | 5/2012 | Eaton | A63H 17/262 301/53.5 |
| 2010/0237686 | A1 * | 9/2010 | Wang | A63H 17/262 301/53.5 |
| 2016/0175726 | A1 * | 6/2016 | Puma | A63H 17/262 446/470 |
| 2017/0008580 | A1 * | 1/2017 | Meager | B60K 1/02 |
| 2017/0305261 | A1 * | 10/2017 | Meager | A61G 1/0275 |

* cited by examiner

WEIGHT DEVICE FOR MODEL CAR

CROSS-REFERENCES TO RELATED APPLICATIONS

This patent specification is based on Japanese utility model application, No. 2019-4278 filed on Nov. 12, 2019 in the Japan Patent Office, the entire contents of which are incorporated by reference herein.

BACKGROUND OF THE INVENTION

1. Field of the Invention

The present invention relates to a weight device for model attached to an outer periphery of a wheel of a radio-controlled model car (hereafter, referred to as RC car).

2. Description of the Related Art

Patent Document 1 discloses an RC car for off-road. The above described RC car for off-road includes a crawler-type RC car which is used for traveling on a rocky road and over a low step, for example. In the above described crawler-type RC car, it is necessary to lower the center of gravity for traveling on a rough road such as a rocky road. In some cases, the center of gravity of the RC car is lowered by directly fixing weights to an outer periphery of a wheel and attaching the wheel to a tire.

Patent Document 1: Japanese Patent Application Laid-Open No. 2007-29139

BRIEF SUMMARY OF THE INVENTION

However, when the center of gravity is lowered by directly fixing the weights to the wheel, it is necessary to fix the weights to the outer periphery of the wheel with good balance for suppressing the vibration caused by the rotation of the wheel. This causes the problem that the work of fixing the weights is extremely complicated.

The purpose of the present invention is to provide a weight device for model capable of easily lowering the center of gravity.

In a weight device for model of the present invention, the weight device is attached to an outer periphery of a wheel of a model car, and the weight device has an annular case extended along a circumferential direction of the wheel, the annular case having an annular internal space; and one or more weight members arranged in the annular internal space. The weight members are configured to be relatively movable in the circumferential direction with respect to the annular case when the annular case is rotated in the circumferential direction.

Because of this, even when the wheel is rotated and the annular case is rotated together with the wheel in the circumferential direction, the weight members are relatively moved in the circumferential direction with respect to the annular case so that the weight members are arranged at the lower side of the internal space. Accordingly, the center of gravity can be easily lowered only by attaching the weight device for model on the outer periphery of the wheel.

In the present invention, it is preferred that the weight members have a spherical shape, the annular case has: an inner cylindrical body; an outer cylindrical body arranged outside the inner cylindrical body to form the annular internal space between the inner cylindrical body and the outer cylindrical body; both annular side plates that close both ends of the annular internal space in a center axis direction of the annular case; and an annular plate that is arranged between the both annular side plates in parallel with the both annular side plates and extended in the circumferential direction so that the annular plate divides the annular internal space into two in the center axis direction, and the one or more weight members are arranged in at least one of the divided annular internal space. Because of this, the weight members are easily moved in the circumferential direction with respect to the annular case even when the width of the center axial direction of the annular case is large.

In the present invention, it is preferred that the annular plate is protruded from an outer peripheral surface of the inner cylindrical body toward the outer cylindrical body, and a clearance which is smaller than a diameter of the weight members is formed between an outer end of the annular plate and the outer cylindrical body. Because of this, fluid can be transferred from one of the annular internal space which is divided into two to the other.

In the present invention, it is preferred that the weight members are configured to be arranged below a center axis of the annular case in a stationary state where the annular case is vertically placed, and a lubricating oil is stored in the annular case so that an oil surface is located below the center axis in the stationary state where the annular case is vertically placed. Because of this, the weight can be adjusted not only by the weight members but also by the lubricating oil. In addition, the lubricating oil can be transferred from one of the internal space to the other through the clearance. Accordingly, the lubricating oil can be stored in each of the spaces evenly.

DETAILED DESCRIPTION OF THE INVENTION

<Schematic Configuration of Wheel Body 1>

Figure 1:
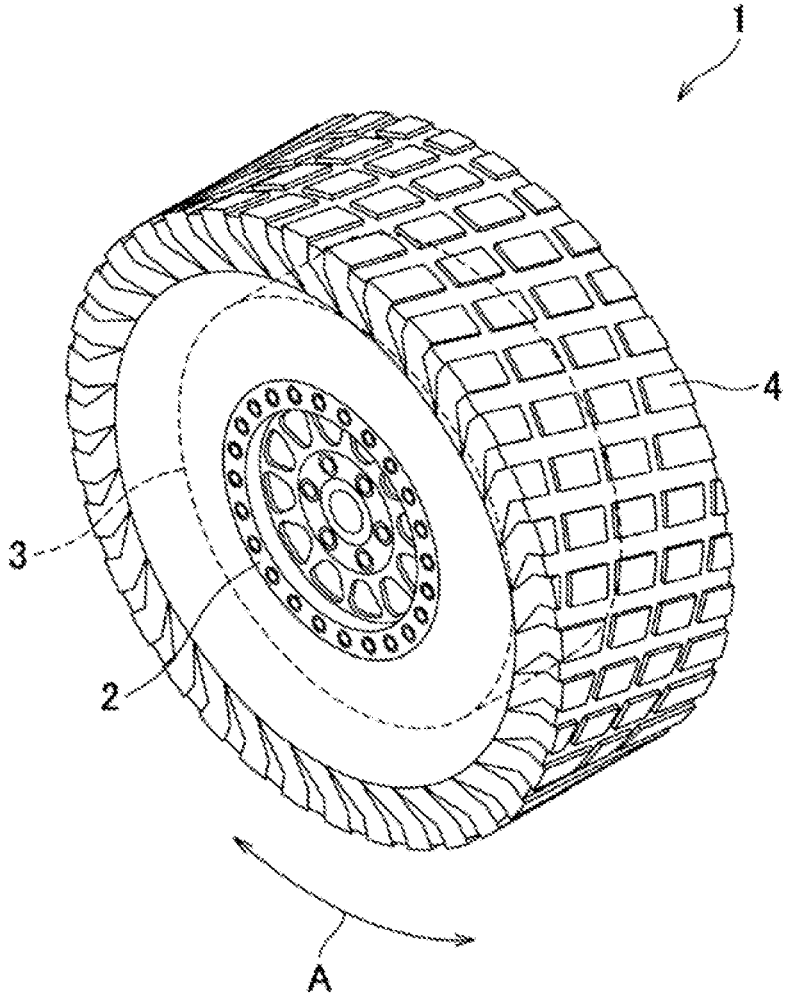
FIG. 1 is a schematic perspective view of a wheel body to which a weight device concerning an embodiment of the present invention is attached.
Figure 2:
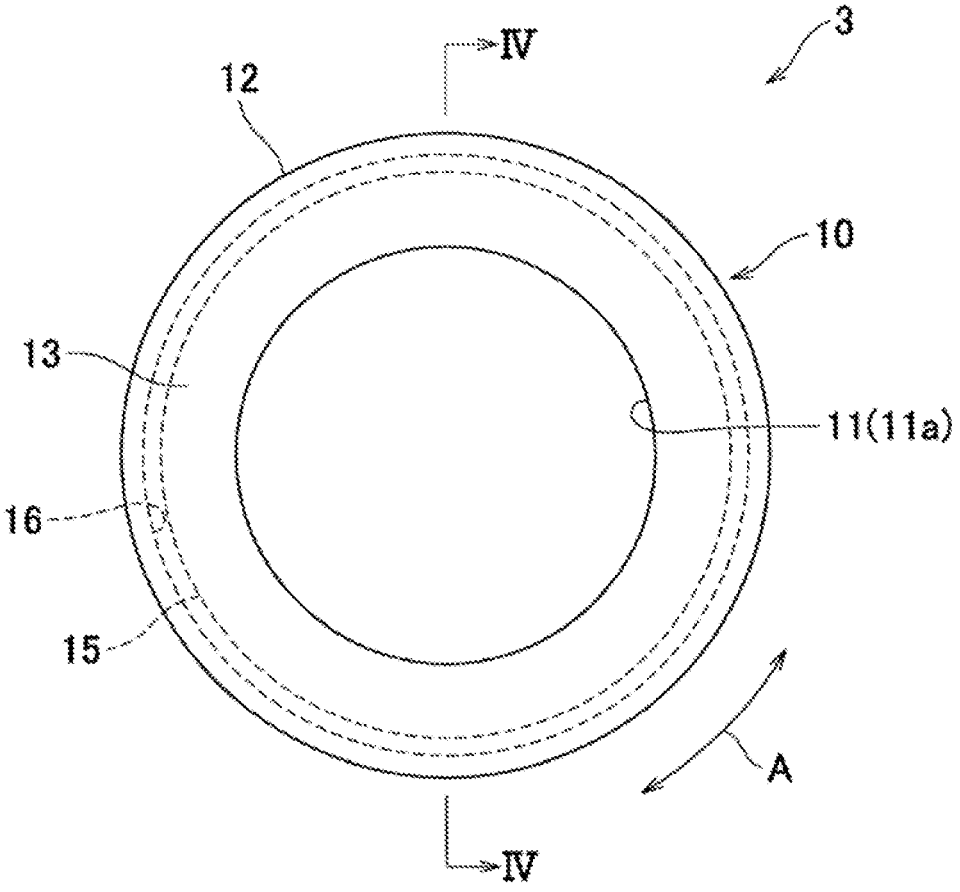
FIG. 2 is a front view of the weight device concerning an embodiment of the present invention.
Figure 3:
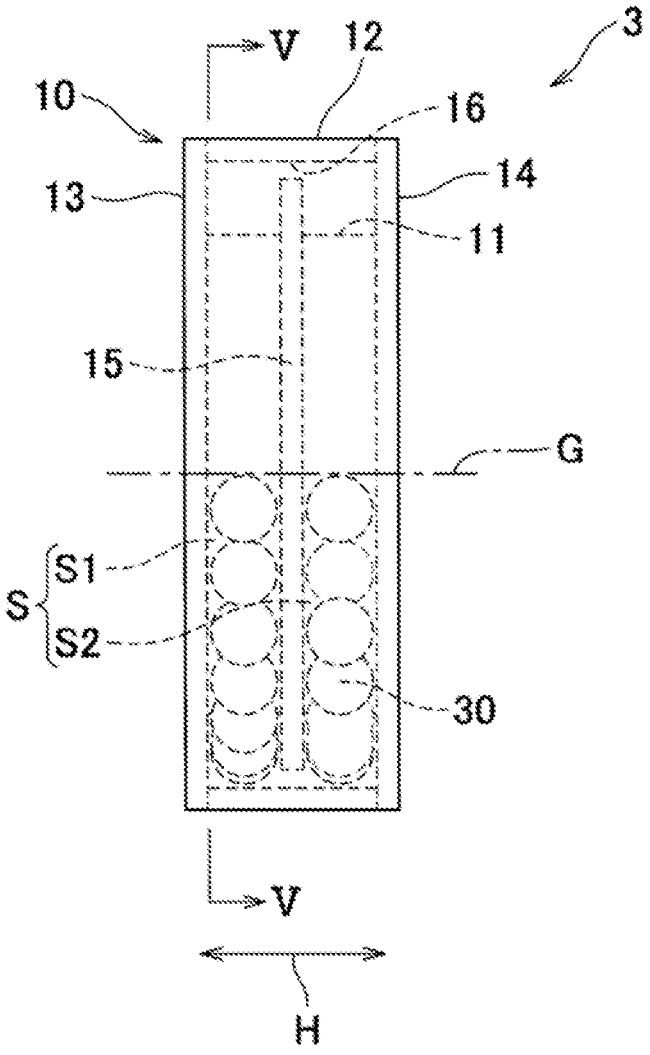
FIG. 3 is a side view of the weight device concerning an embodiment of the present invention.
Figure 5:
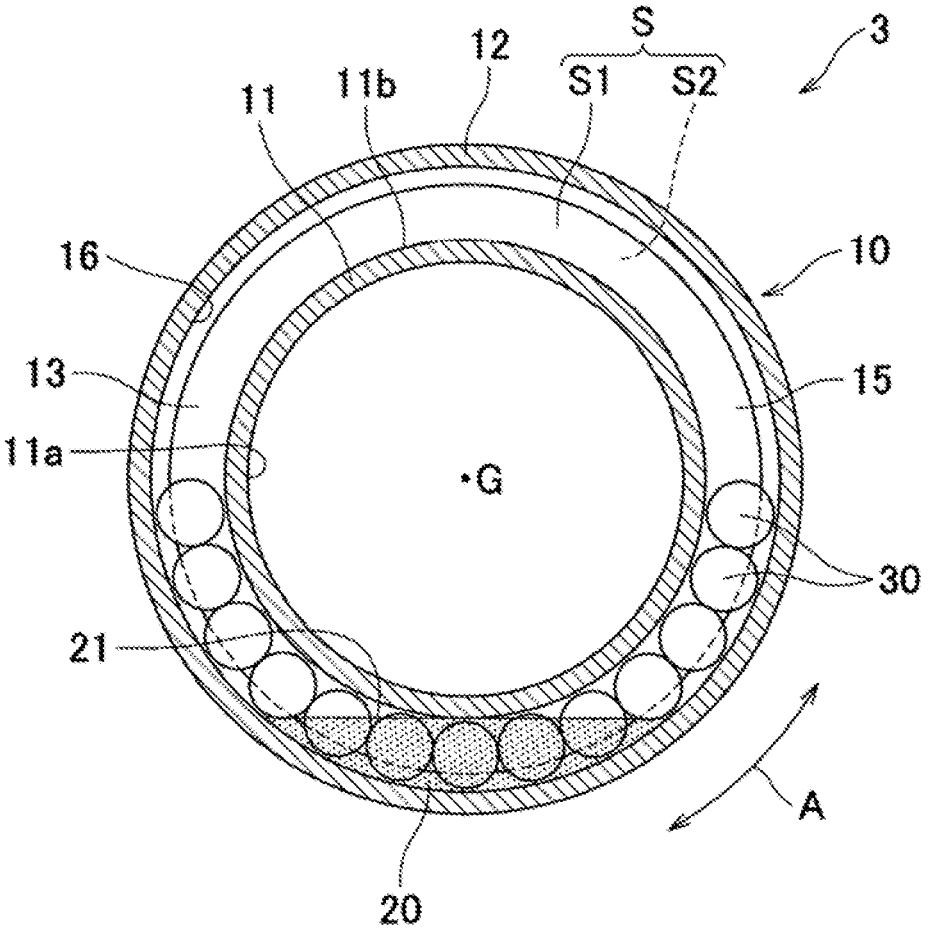
FIG. 5 is a cross-sectional view cut along line V-V in FIG. 3.

Hereafter, a wheel body to which a weight device for model concerning an embodiment of the present invention is attached will be explained referring to FIG. 1. In the present embodiment, as shown in FIG. 1, a wheel 2 assembled with a tire 4 is referred to as a wheel body 1. In addition, the wheel body 1 of the present embodiment is used for a crawler-type RC car. The wheel body 1 has: a wheel 2; a weight device 3 for model (shown by broken lines in FIG. 1) attached to an outer periphery of the wheel 2 so as to extend along a circumferential direction A of the wheel 2; an annular sponge (not illustrated) attached to an outer periphery of the weight device 3; and a tire 4 attached to the wheel 2 while housing the annular sponge and the weight device 3 inside. Although the weight device 3 is used for the wheel body 1 of a crawler-type RC car, it is also possible to use the weight device 3 for the wheel body of other than the crawler-type RC car. Note that the circumferential direction A shown in FIG. 1 is also shown in FIG. 2 and FIG. 5 similarly.

<Assembling Method of Wheel Body 1>

Next, the assembling method of the wheel body 1 will be explained. First, the sponge (not illustrated) is inserted into the tire 4. Then, the weight device 3 is arranged inside the sponge. At this time, the weight device 3 is also arranged inside the tire 4. Note that it is also possible to insert the weight device 3 into the tire 4 in a state that the sponge is preliminarily attached to an outer periphery of the weight device 3. Then, the wheel 2 is fitted to an inner peripheral surface 11*a* (shown in FIG. 2) of the weight device 3. Namely, the weight device 3 is attached to the outer periphery of the wheel 2. And then, a bead part of the tire 4 is fixed to the outer peripheral edge of the wheel 2. Thus, the wheel body 1 is assembled.

<Configuration of Weight Device 3>

As shown in FIG. 2 to FIG. 5, the weight device 3 has an annular case 10 extended along the circumferential direction A of the wheel 2, and a plurality of weight members 30 to function as a balance weight. The weight members 30 of the present embodiment are made of metal, more specifically made of iron. Note that the weight members 30 can be made of other metals than iron. In addition, the weight members 30 have a spherical shape, and 26 weight members 30 are housed in the case 10.

Figure 4:
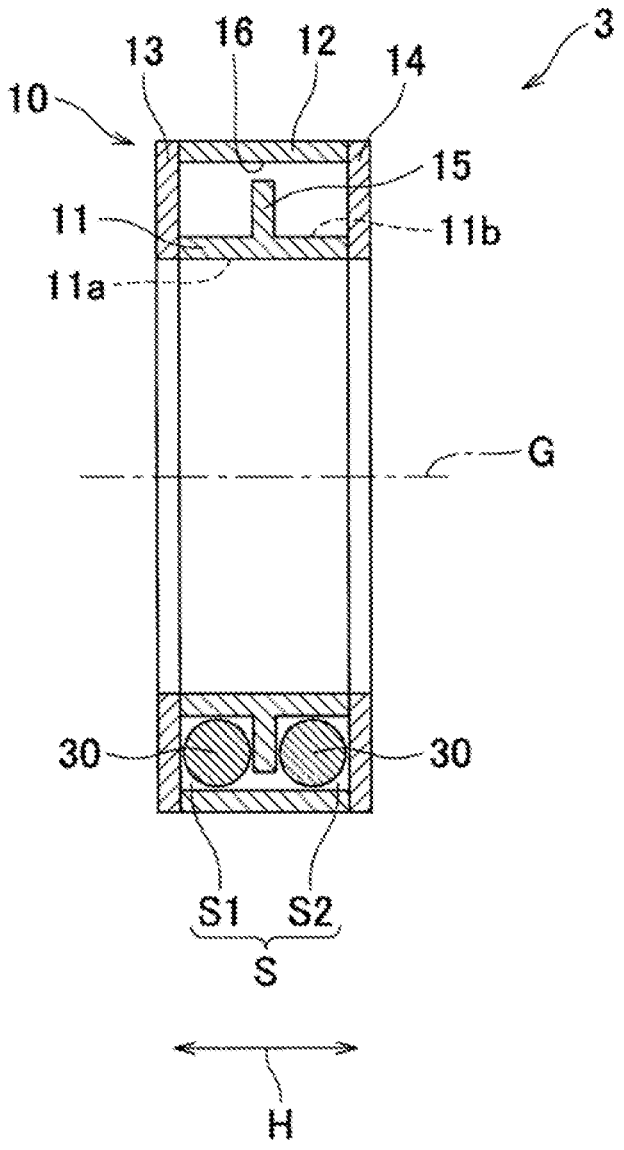
FIG. 4 is a cross-sectional view cut along line IV-IV in FIG. 2.

As shown in FIG. 4 and FIG. 5, the case 10 has an inner cylindrical body 11, an outer cylindrical body 12 and two side plates 13, 14. The inner cylindrical body 11 has an inner diameter that allows the wheel 2 to be fitted to the inner peripheral surface 11*a*. The outer cylindrical body 12 has an inner diameter larger than an outer diameter of the inner cylindrical body 11 so that an internal space S is formed between the inner cylindrical body 11 and the outer cylindrical body 12. More specifically, the inner diameter of the outer cylindrical body 12 is slightly larger than the value obtained by adding the diameter of the weight members 30 to the outer diameter of the inner cylindrical body 11. In addition, the width of the inner cylindrical body 11 is same as the width of the outer cylindrical body 12 in an axial direction H of a center axis G of the case 10.

As shown in FIG. 4 and FIG. 5, both of two side plates 13, 14 are strip-shaped plates annularly extending along the circumferential direction A. The inner diameter of the side plates 13, 14 is same as the inner diameter of the inner cylindrical body 11, and the outer diameter of the side plates 13, 14 is same as the outer diameter of the outer cylindrical body 12. In addition, the side plate 13 connects one end of the inner cylindrical body 11 and one end of the outer cylindrical body 12 in the axial direction H to close one end of the internal space S. In addition, the side plate 14 connects the other end of the inner cylindrical body 11 and the other end of the outer cylindrical body 12 in the axial direction H to close the other end of the internal space S. Namely, both ends in the axial direction H of the internal space S are closed by both side plates 13, 14.

As shown in FIG. 4 and FIG. 5, an annular plate 15 is formed on the inner cylindrical body 11 to annularly extend along the circumferential direction A from an outer peripheral surface 11*b* toward the outer cylindrical body 12. The annular plate 15 is arranged at the center of the inner cylindrical body 11 in the axial direction H. Namely, the annular plate 15 is arranged between the both side plates 13, 14 to divide the internal space S into two. In addition, an interval (separation distance) between the annular plate 15 and the both side plates 13, 14 in the axial direction H is slightly larger (longer) than the diameter of the weight members 30. Because of this, the cross-sectional size of spaces S1, S2 which are formed by dividing the internal space S into two by the annular plate 15 is slightly larger than the size of the weight members 30 as shown in FIG. 4. Therefore, when the wheel body 1 is rotated and the case 10 is rotated together with the wheel 2 in the circumferential direction A, the plurality of weight members 30 tend to stay at a current position by the gravity. Thus, the weight members 30 are relatively movable with respect to the case 10. In other words, the weight members 30 are configured to be relatively movable with respect to the case 10 when the case 10 is rotated in the circumferential direction A. In addition, 13 weight members 30 are arranged in one space S1 and 13 weight members 30 are arranged in the other space S2. As shown in FIG. 5, the weight members 30 are arranged below the center axis G in a stationary state where the case 10 is vertically placed. The state where the case 10 is vertically placed means the state where the center axis G of the case 10 is directed horizontally.

In addition, the annular plate 15 is separated from the outer cylindrical body 12 so that an annular clearance 16 is formed between an outer end of the annular plate 15 and the outer cylindrical body 12. As shown in FIG. 4, the clearance 16 is smaller (shorter) than the diameter of the weight members 30. As described above, since the clearance 16 is formed, fluid such as later described lubricating oil 20 can be transferred from one space S1 (or space S2) to the other space 2 (or space S1) which are formed by diving the internal space S into two.

In addition, as show in FIG. 5, lubricating oil (grease) 20 is stored in the case 10. In the present embodiment, silicone oil is used as the lubricating oil. However, other oil than the silicon oil can be used as the lubricating oil. In the present embodiment, the storage amount of the lubricating oil 20 in the case 10 is adjusted so that an oil surface (oil level) 21 is approximately in contact with the lower end of the inner cylindrical body 11 in a stationary state where the case 10 is vertically placed, as shown in FIG. 5. However, the storage amount of the lubricating oil 20 can be any amount as long as the oil surface 21 is located below the center axis G As described above, since the lubricating oil 20 is stored in the case 10, the weight can be adjusted not only by the weight members 30 but also by the lubricating oil. Therefore, by changing the setting of the weight, it is possible to cope with the phenomenon typically caused by torque twist in the RC car where one of the front wheels is raised. In addition, the lubricating oil 20 can be transferred from one space S1 to the other space S2 of the internal space S through the clearance 16. Therefore, the lubricating oil 20 can be stored in each of the space S1 and the space S2 evenly. In addition, since the oil surface 21 is located below the center axis G, the center of gravity can be further lowered. Note that the density of the lubricating oil 20 can be any value as long as it is lower than the density of the weight members 30.

As described above, in the weight device 3 of the present embodiment, even when the wheel body 1 (wheel 2) is rotated and the case 10 is rotated together with the wheel 2 in the circumferential direction A, the plurality of weight members 30 are relatively moved in the circumferential direction A with respect to the case 10 so as to stay at the lower side of the case 10 (i.e., lower side of the center axis G) by the gravity. Therefore, the center of gravity can be easily lowered only by attaching the weight device 3 on the outer periphery of the wheel 2. Since the center of gravity can be lowered inside the wheel body 1, the effect of the drag brake can be increased. Furthermore, compared to the normal wheel body (i.e., wheel body without having weight device 3), the maximum climbing angle in the RC car is larger and less overturn during slope traveling.

In addition, the plurality of weight members 30 is arranged below the center axis G in a stationary state where the case 10 is vertically placed. The center of gravity can be lowered compared to the case where the weight member having the weight same as the total weight of the plurality of weight members 30 is arranged above the center axis G of the case 10 (i.e., center axis of the wheel 2). Accordingly, the traveling of the RC car becomes more stable.

In addition, since the annular plate 15 for dividing the internal space S into two is provided, the width of the spaces S1, S2 in which the weight members 30 are moved can be adjusted even when the width of the axial direction H of the case 10 (internal space S) is large. Therefore, when the weight members 30 are relatively moved with respect to the case 10, the weight members 30 are prevented from moving obliquely in the circumferential direction A. Thus, the weight members 30 are easily moved in the circumferential direction A. Furthermore, it is preferred that the width of the axial direction H of the internal space S or the spaces S1, S2 is larger (wider) than the width (diameter) of the weight members 30 and smaller (narrower) than the sum of the width of the weight members 30 and a half of the width of the weight members 30. Thus, the weight members 30 are more easily moved in the circumferential direction A relative to the case 10. In addition, it is preferred that the distance between the inner cylindrical body 11 and the outer cylindrical body 12 is larger (longer) than the width (diameter) of the weight members 30 and smaller (shorter) than the sum of the diameter of the weight members 30 and the radius of the weight members 30. Thus, the weight members 30 are more easily moved in the circumferential direction A relative to the case 10 and the weight members 30 are prevented from blocking with each other in the circumferential direction A.

Although the preferred embodiments of the present invention are explained above, the present invention is not limited to the above described embodiments. Various modification is possible within the range described in the claims. For example, although 26 weight members 30 are used in the above described weight device 3, the number of weight members 30 to be used can be 1 or more and less than 26, or can be 27 or more. In addition, although the weight members 30 have a spherical shape in the present embodiment, the shape can be any shape as long as the weight members 30 can be relatively moved in the internal space S with respect to the case 10 when the case 10 is rotated in the circumferential direction A. For example, when the weight members 30 are formed in a cylindrical shape or an arc shape extending along the circumferential direction A, the weight members 30 are easily moved in the circumferential direction A relative to the case 10. It is also possible to arrange the weight members 30 from the lower side of the case 10 toward the upper side exceeding the center axis G of the case 10.

In addition, the weight device 3 can have two or more annular plates for dividing the internal space S into three or more in the axial direction H. It is also possible not to provide the annular plate 15 on the weight device 3.

It is also possible not to store the lubricating oil 20 in the case 10, and to store lubricating oil 20 in the case 10 so that the oil surface 21 is located above the center axis G in a stationary state where the case 10 is vertically placed.

In addition, the case 10 can be attached to the wheel 2 so that the wheel 2 is idly rotatable with respect to the case 10. Namely, the inner diameter of the case 10 can be specified to be slightly larger than the outer diameter of an attachment part where the case 10 is attached to the wheel 2. Thus, the case 10 itself is hardly rotated in the circumferential direction A, and the weight members 30 stay at the lower side of the case 10 more significantly. As a result, the center of gravity can be lowered stably.

It is also possible to connect the annular plate 15 and the outer cylindrical body 12. In this case, a through hole can be formed around the outside end part of the annular plate 15. Thus, the lubricating oil 20 can be transferred between the space S1 and the space S2. In addition, it is preferred that the size of the through hole is specified so that the weight members cannot be transferred between the space S1 and the space S2.

DESCRIPTION OF THE REFERENCE NUMERALS

1: wheel body
2: wheel
3: weight device (the weight device for model)
10: case
11: inner cylindrical body
11*b*: outer peripheral surface
12: outer cylindrical body
13, 14: side plates
15: annular plate
16: clearance
20: lubricating oil
21: oil surface
30: weight members
A: circumferential direction
G: center axis
H: axial direction
S: internal space

What is claimed is:

1. A weight device for a model car, the weight device being attached to an outer periphery of a wheel of the model car, the weight device comprising:

an annular case extended along a circumferential direction of the wheel, the annular case having an annular internal space; and one or more weight members arranged in the annular internal space, wherein the weight members are configured to be relatively movable in the circumferential direction with respect to the annular case when the annular case is rotated in the circumferential direction, the annular case has:

an inner cylindrical body;

an outer cylindrical body arranged outside the inner cylindrical body to form the annular internal space between the inner cylindrical body and the outer cylindrical body;

annular side plates that close both ends of the annular internal space in a center axis direction of the annular case; and an annular plate that is arranged between both of the annular side plates in parallel with both of the annular side plates and extended in the circumferential direction so that the annular plate divides the annular internal space into a first housing space and a second housing space in the center axis direction, the one or more weight members are arranged in at least one of the first housing space and the second housing space, the annular plate is protruded from an outer peripheral surface of the inner cylindrical body toward the outer cylindrical body, a clearance which is smaller than a diameter of the weight members is formed between an outer end of the annular plate and the outer cylindrical body, a lubricating oil is stored in the annular case so that an oil surface is located below a center axis of the annular case in a stationary state where the annular case is vertically placed, the lubricating oil can be transferred between the first housing space and the second housing space through the clearance, the weight members have a spherical shape, the weight members are arranged below the center axis of the annular case in the stationary state where the annular case is vertically placed, the weight members are configured to be relatively moved in the circumferential direction with respect to the annular case so as to stay below the center axis of the annular case, and the annular case is attached to the outer periphery of the wheel so that the wheel is idly rotatable with respect to the annular case.

* * * * *